US007014596B2

(12) United States Patent
Gray

(10) Patent No.: US 7,014,596 B2
(45) **Date of Patent: *Mar. 21, 2006**

(54) EXERCISE DEVICE

(75) Inventor: Gary W. Gray, Adrian, MI (US)

(73) Assignee: True Fitness Technology, Inc., O'Fallon, MO (US)

( * ) Notice: Subject to any disclaimer, the term of this patent is extended or adjusted under 35 U.S.C. 154(b) by 126 days.

This patent is subject to a terminal disclaimer.

(21) Appl. No.: 10/608,845

(22) Filed: Jun. 27, 2003

(65) Prior Publication Data

US 2004/0097338 A1 May 20, 2004

Related U.S. Application Data

(60) Continuation of application No. 09/577,914, filed on May 24, 2000, now Pat. No. 6,679,813, which is a division of application No. 09/174,306, filed on Oct. 16, 1998, now Pat. No. 6,077,202.

(60) Provisional application No. 60/062,577, filed on Oct. 17, 1997.

(51) Int. Cl.
*A63B 22/04* (2006.01)

(52) U.S. Cl. ..... 482/52; 482/53

(58) Field of Classification Search ..... 482/51–53, 482/70, 71

See application file for complete search history.

(56) References Cited

U.S. PATENT DOCUMENTS 3,511,500 A * 5/1970 Dunn ..... 482/113

(Continued)

*Primary Examiner*—Stephen R. Crow

(74) *Attorney, Agent, or Firm*—Lewis, Rice & Fingersh, L.C.

(57) ABSTRACT

The exercise device of the present invention has a base having two side members and front member that extends between the side members. At least one truss member extends from the base. A rotatable shaft is positioned on the truss member and a flywheel is mounted on the shaft. A rotatable drive shaft is mounted on the truss member and a first one-way clutch and a second one-way clutch are mounted on the drive shaft. A means is provided for operatively connecting the drive shaft to the rotatable shaft whereby rotation of the drive shaft causes the rotatable shaft to rotate. A pair of arms have a first end that is pivotally mounted on the base and a second end that extends from the base. A foot pad is positioned on the second end of each of the arms. The foot pads are disposed to move in an arcuate path towards and away from the side members of the base and the movement of the foot pads is in a direction that is substantially parallel to the front member of the base. A lever is operatively connected to each arm whereby movement of the arms causes a movement of the levers. A means is provided for operatively connecting one of the levers to the first one-way clutch and the other lever to the second one-way clutch whereby movement of the arms towards the base causes the levers to rotate the first and second one-way clutches in a direction that causes the drive shaft to rotate which in turn rotates the shaft upon which the flywheel is mounted. The flywheel provides resistance to movement of the arms and the levers. Movement of the arms away from the base rotates the levers in a direction that does not activate the first and second one-way clutches and does not cause the drive shaft to rotate.

16 Claims, 5 Drawing Sheets

U.S. PATENT DOCUMENTS 4,563,001 A * 1/1986 Terauds ..... 482/53
4,708,338 A * 11/1987 Potts ..... 482/52
5,298,002 A 3/1994 Lin
5,665,033 A * 9/1997 Palmer ..... 482/71
5,807,210 A * 9/1998 Devlin ..... 482/52
6,077,202 A * 6/2000 Gray ..... 482/57
6,679,813 B1 * 1/2004 Gray ..... 482/71

* cited by examiner

EXERCISE DEVICE

CROSS REFERENCE TO RELATED APPLICATIONS

This application is a continuation of and claims priority to U.S. patent application Ser. No. 09/577,914 filed May 24, 2000 now U.S. Pat. No. 6,679,813 which in turn is a Divisional of U.S. patent application Ser. No. 09/174,306 filed Oct. 16, 1998 now U.S. Pat. No. 6,077,202 which in turn claims priority to U.S. Provisional Patent Application Ser. No. 60/062,577 filed Oct. 17, 1997. The entire disclosure of all these documents is herein incorporated by reference.

BACKGROUND OF THE INVENTION

A regimen of regular exercise is beneficial to the general physical well being of a person. Although outdoor exercise, e.g., walking or jogging is preferable, the vagaries of the weather and other factors often preclude adherence to a regular outdoor exercise program. To this end, numerous indoor exercise devices have been developed ranging from the familiar treadmills and stationary bicycles to complex, elaborate apparatus designed to simulate stair climbing or other body exercising functions. Many such complex devices are not only quite expensive, but due to their size are not readily portable or easily storable and moreover, require frequent maintenance.

It is therefore the principal object of this invention to provide a compact, reliable exercise and body toning apparatus, particularly for exercising and toning the lower body, which is both simple to use and usable by persons having a wide range of strength capabilities.

SUMMARY OF THE INVENTION

The exercise device of the present invention has a base having two side members and front member that extends between the side members. At least one truss member extends from the base. A rotatable shaft is positioned on the truss member and a flywheel is mounted on the shaft. A rotatable drive shaft is mounted on the truss member and a first one-way clutch and a second one-way clutch are mounted on the drive shaft. A means is provided for operatively connecting the drive shaft to the rotatable shaft whereby rotation of the drive shaft causes the rotatable shaft to rotate. A pair of arms have a first end that is pivotally mounted on the base and a second end that extends from the base. A foot pad is positioned on the second end of each of the arms. The foot pads are disposed to move in an arcuate path towards and away from the side members of the base and the movement of the foot pads is in a direction that is substantially parallel to the front member of the base. A lever is operatively connected to each arm whereby movement of the arms causes a movement of the levers. A means is provided for operatively connecting one of the levers to the first one-way clutch and the other lever to the second one-way clutch whereby movement of the arms towards the base causes the levers to rotate the first and second one-way clutches in a direction that causes the drive shaft to rotate which in turn rotates the shaft upon which the flywheel is mounted. The flywheel provides resistance to movement of the arms and the levers. Movement of the arms away from the base rotates the levers in a direction that does not activate the first and second one-way clutches and does not cause the drive shaft to rotate.

DETAILED DESCRIPTION OF THE PREFERRED EMBODIMENTS

Figure 1:
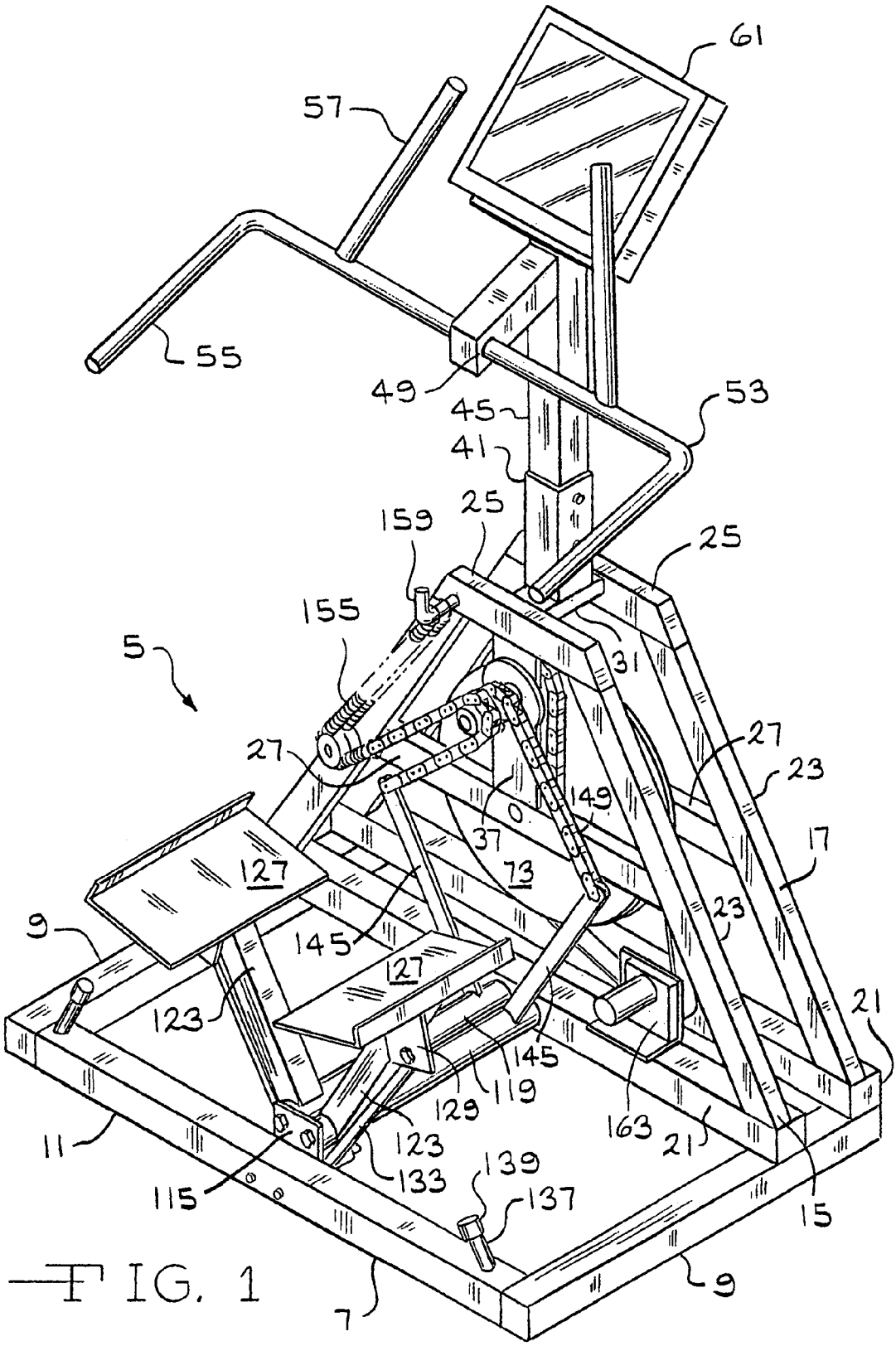
FIG. 1 is a perspective view of the invention.
Figure 2:
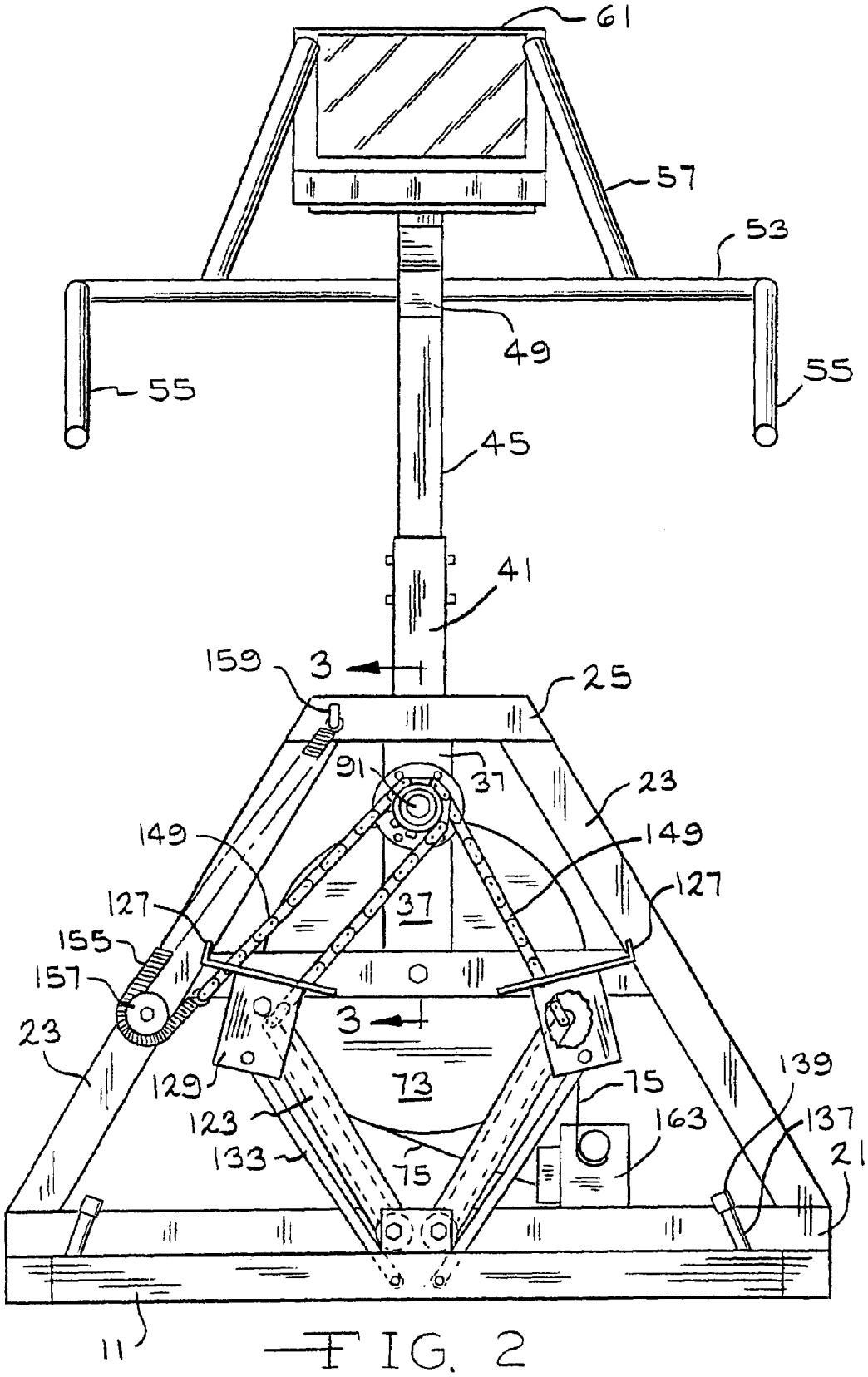
FIG. 2 is a front elevational view.
Figure 3:
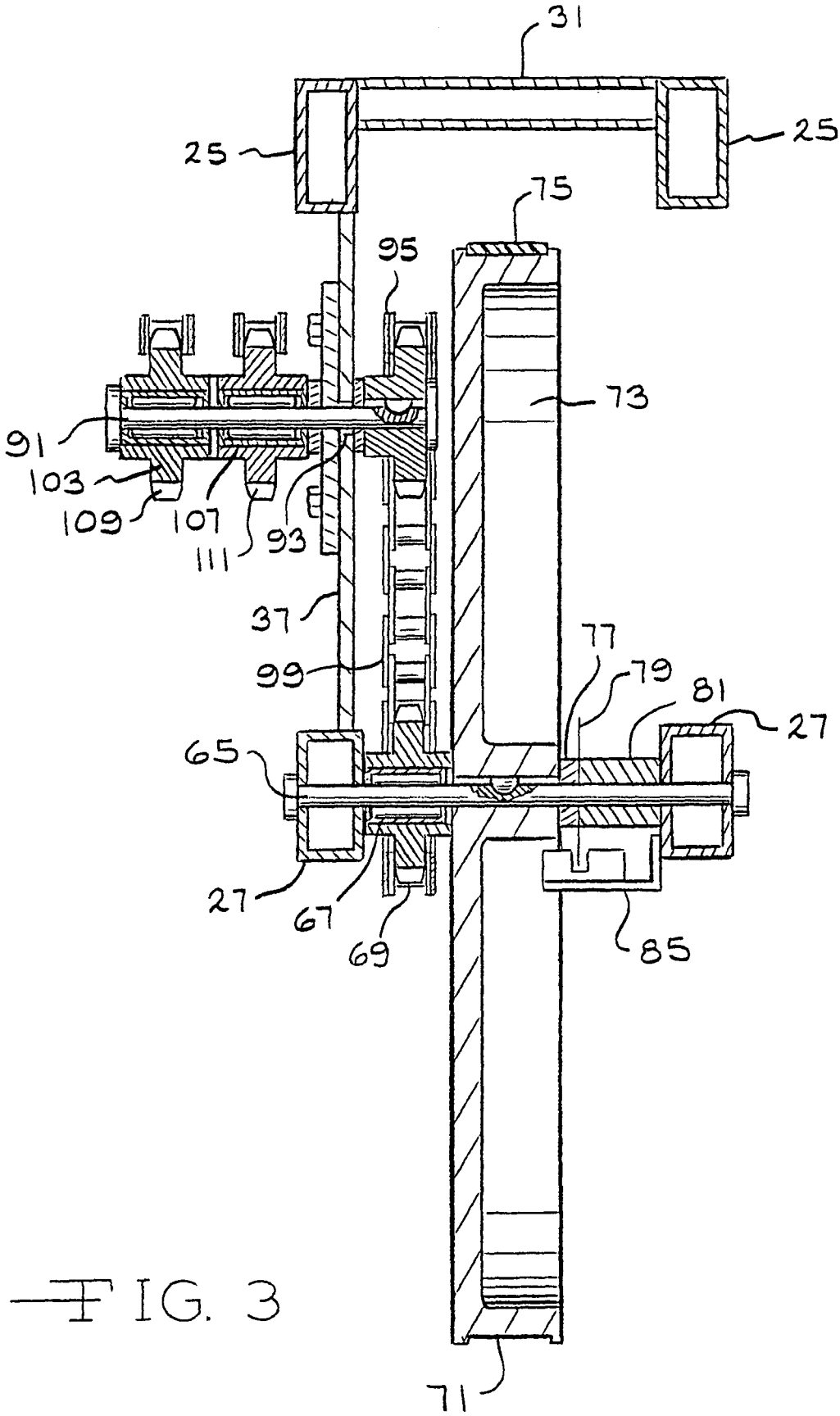
FIG. 3 is a partial cross-sectional view taken along line 3—3 in FIG. 2.
Figure 4:
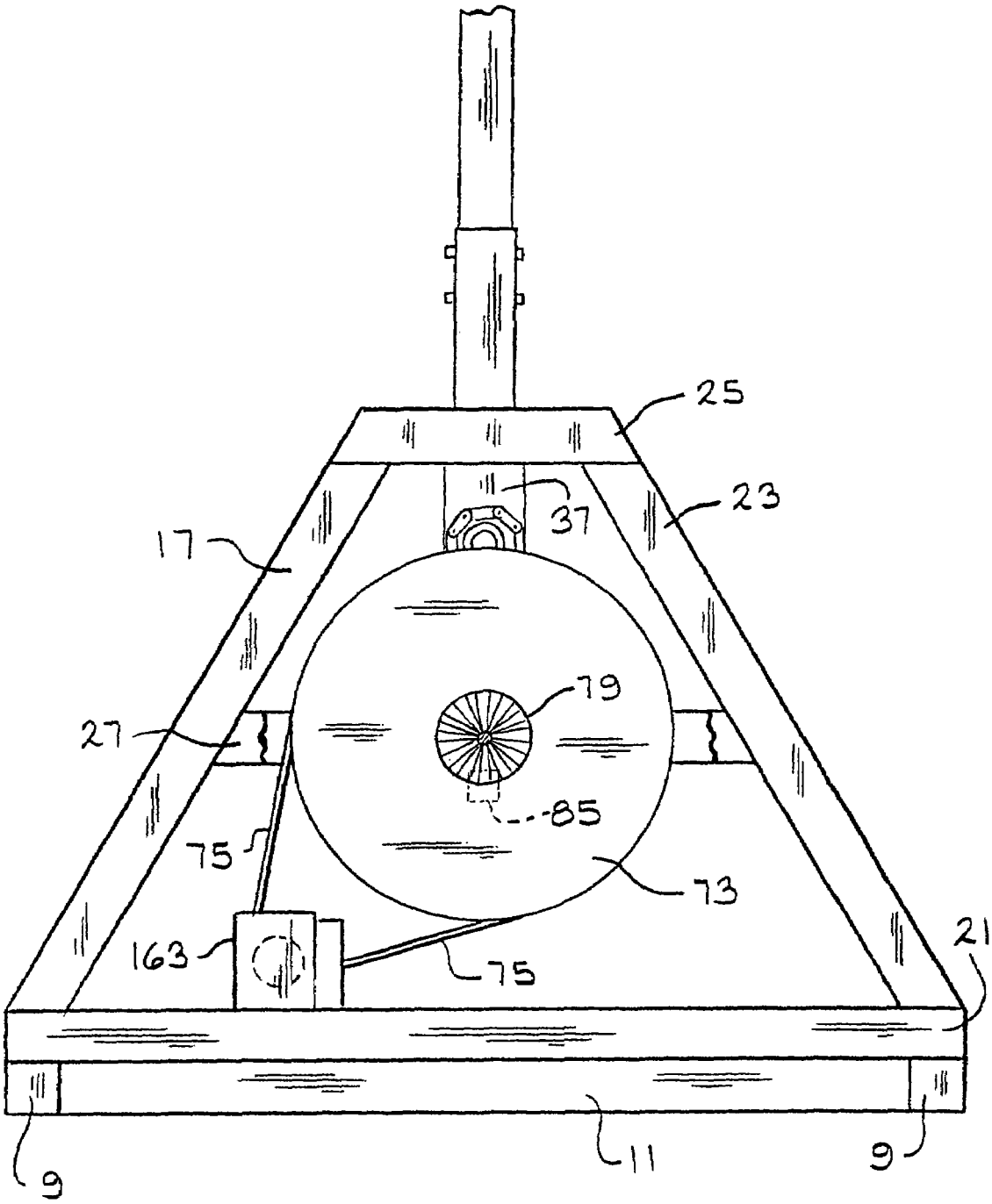
FIG. 4 is a partial back view.

The present invention is directed to an exercise device for providing movement to the lower extremities of a user. More particularly, the-exercise device utilizes a side-to-side stepping motion for exercising the major muscle groups of the lower extremities. The features of the invention will be more clearly understood by referring to the accompanying drawings and the following specification.

The exercise device 5 as shown in FIGS. 1–4 has a substantially U-shaped base 7 having two side members 9 and a front member 11. Positioned on the U-shaped base 7 is a first truss member 15 and a second truss member 17. The first and second truss members 15 and 17 are positioned to extend from one side member 9 to the opposite side member 9 of the U-shaped base 7. The first and second truss members 15 and 17 are positioned at the end of the side members 9 that is spaced apart from the front member 11. The first and second truss members 15 and 17 extend in a substantially vertical or perpendicular direction from the U-shaped base 7.

The first truss member 15 and second truss member 17 each have a horizontal base 21 that is positioned to be in contact with each side member 9 of the U-shaped base 7. Each truss member has sides 23 that extend from the horizontal base 21 in a substantially vertical direction. The sides 23 are generally converging as they extend from the horizontal base 21 and a top cross member 25 is secured to the end of the sides 23 that is spaced apart from the horizontal base 21. The top cross member 25 is disposed to be substantially parallel to the horizontal base 21. A brace 27 extends between the sides 23 of the first and second truss members 15 and 17. The brace 27 is disposed so that it is substantially midway between the horizontal base 21 and the top cross member 25. The brace 27 is positioned so that it is substantially parallel to the horizontal base 21. As the sides 23 converge as they extend upwardly from the horizontal base 21, the top cross member 25 is usually between one-third and about two-thirds the length of the horizontal base 21. A plate 31 is secured to the top cross member 25 on the first truss member 15 and the top cross member 25 on the second truss member 17. The plate 31 maintains the first and second truss members 15 and 17 in the same spaced apart relationship that is established by the positioning of the first and second truss members on the U-shaped base 7. Accordingly, the sides 23 and top cross members 25 are maintained in substantially parallel relationship. A mounting bracket 37 extends between the top cross member 25 and the brace 27 on the first truss member 15.

Positioned on the plate 31 is a connecting bracket 41 that is configured to securely retain a stem 45. The stem 45 extends substantially vertically from the plate 31. The stem 45 has a neck portion 47 that extends from the stem 45 in a direction toward the front member 11 of the U-shaped base 7. The neck portion 47 has an aperture 49 for receiving a hand grip bar 53. The hand grip bar 53 can have substantially horizontal hand grips 55 and substantially vertical hand grips 57. A computer display 61 can be mounted on the end of the stem 45 that is spaced apart from the connecting bracket 41.

A shaft 65 extends between the brace 27 on the first truss member 15 and the brace 27 on the second truss member 17. A one-way clutch 67 having a sprocket 69 is mounted on the shaft 65 adjacent to the first truss member 15. A flywheel 73 is mounted on the shaft 65 adjacent to the one-way clutch 67. A washer 77, a counter wheel 79 and a spacer 81 are positioned on the shaft 65 between the flywheel 73 and the brace 27 on the second truss member 17. The counter wheel 79 is secured to the shaft 65 so that the counter wheel 79 rotates when the flywheel 73 is caused to rotate. Connected to the brace 27 on the second truss member 17 is a counting pickup 85 that is disposed to interact with the counter wheel 79 mounted on the shaft 65. The counting pickup 85 monitors the rotation of the counter wheel 79 to give communication of the speed of rotation of the flywheel 73. A groove 71 is positioned in the outer periphery of the flywheel 73. A tension belt 75 is positioned in the groove 71 for providing resistance to rotation for the flywheel 73.

A drive shaft 91 is rotatably mounted in a aperture 93 on the mounting bracket 37 that extends between the brace 27 and the top cross member 25 on the first truss member 15. A sprocket 95 is secured to the drive shaft 91 on the side of the mounting bracket 37 that is adjacent to the flywheel 73. A drive means 99 such as a chain operatively connects the sprocket 95 on the drive shaft 91 with the sprocket 69 connected to the one-way clutch 67 mounted on the shaft 65. Positioned on the drive shaft 91 is a first one-way clutch 103 and a second one-way clutch 107. A sprocket 109 is mounted on the first one-way clutch 103 and a sprocket 111 is mounted on the second one-way clutch 107.

A support flange 115 is secured to the front member 11 of the U-shaped base 7. A pair of rotatable cylinders 119 extend between the support flange 115 and the horizontal base 21 of the first truss member 15. The rotatable cylinders 119 are mounted in a manner whereby they are free to rotate around the longitudinal axis of each cylinder. An arm 123 is secured to each rotatable cylinder 119 on the end of the cylinders that is adjacent the support flange 115. A foot pad 127 having a base plate 129 is pivotally secured to the end of each arm 123 that is spaced apart from the rotatable cylinders 119. The base plate 129 is positioned beneath each foot pad 127 and the base plate 129 is secured to the arms 123 in a manner to allow the foot pads 127 to be pivotally mounted on the arms 123. A link member 133 is positioned to extend from the base plate 129 to the front member 11 of the U-shaped base 7. The link member 133 is pivotally secured to the base plate 129 and to the front member 11. The link member 133 is positioned so that it is not quite parallel to the arms 123. The link members 133 and arm members 123 cooperate to maintain the foot pads 127 at an angle of about 10° to about 20° with respect to the surface upon which the exercise device 5 is positioned. The link members 133 are disposed to maintain this angular relationship as the foot pads 127 rotate with the arms 123. Positioned on the front member 11 of the U-shaped base 7 are a pair of stops 137. The stops 137 extend upwardly from the front member 11 and have a cushion region 139 on the end that is spaced apart from the front member 11. The stops 137 are disposed on the front member 11 to engage the foot pads 127 to stop further downward rotation of the foot pads 127.

A lever 145 is secured to each rotatable cylinder 119 on the end of the cylinder that is adjacent the horizontal base 21 of the first truss member 15. The levers 145 are disposed to extend upwardly from the rotatable cylinders 119 and are disposed at an angle that is substantially the same as the angle at which the arms 123 are positioned on the rotatable cylinders 119. A chain 149 is connected to the end of each lever 145 that is spaced apart from the rotatable cylinders 119. The chain 149 that is connected to one lever 145 extends around the first one-way clutch 103 and the chain 149 from the other lever arm 145 extends around the second one-way clutch 107. The ends of the chains 149 that are spaced apart from the levers 145 are connected to a spring member 155. The spring members 155 extend from the chains 149 around idler rolls 157 and the ends of the spring members 155 that is opposite to the end that is connected to the chains 149 is secured to a hook 159 that is mounted on the top cross member 25 of the first truss member 15. The chains 149 are positioned on the first one-way clutch 103 and second one-way clutch 107 so that the clutches are engaged and cause the drive shaft 91 to rotate when the foot pads 127 are moved in a direction toward the U-shaped base 7 of the exercise device 5. When the foot pads 127 are moving in a direction away from the U-shaped base 7, the first one-way clutch 103 and second one-way clutch 107 are not engaged and they can rotate freely and without causing the drive shaft 91 to rotate.

Positioned on the horizontal base 21 of the first truss member 15 is a tension control 163. The tension control 163 is connected to the tension belt 75 that is positioned in the groove 71 in the flywheel 73. The tension control 163 can be activated to increase or decrease the tension on the tension belt 75 to vary the resistance to rotation for the flywheel 73.

In operation, a person desiring to use the exercise device 5 will position his feet on the foot pads 127 and place his hands on the hand grip bar 53. The user will stand in a relatively upright or vertical position on the exercise device 5. To initiate the exercise motion, the user directs a larger portion of his body weight onto one of the foot pads 127 causing the foot pad to rotate on the rotatable cylinder 119 in a direction toward the side members 9 of the U-shaped base 7. This motion for the foot pad 127 will also cause lever 145 to rotate in the same direction toward the U-shaped base 7. As the lever 145 rotates toward the U-shaped base 7 the chain 149 connected to the lever 145 is also caused to advance in a direction that will cause either the first one-way clutch 103 or the second one-way clutch 107 to be rotated in a direction whereby the one-way clutch engages the drive shaft 91 and causes the drive shaft 91 to be rotated. The advancement of the chain 149 causes the spring member 155 connected to the chain to be elongated. After one foot pad 127 has been caused to move in a direction toward the U-shaped base 7, the user then positions a substantial portion of his body weight on the other foot pad 127 to cause that foot pad to advance toward the side members 9 of the U-shaped base 7. As the other foot pad 127 is advanced in a direction toward the U-shaped base 7, the lever 145 connected to this fool pad through the rotatable cylinder 119 will cause the chain 149 to advance over one of the one-way clutches in a direction that engages a one-way clutch and causes the drive shaft 91 to rotate. As one foot pad 127 is advanced toward the U-shaped base 7, the opposite foot pad 127 is rotated away from the U-shaped base 7 by the force of the spring member 155 acting through the chain 149 on the lever 145 connected to the rotatable cylinder 119 on which the foot pad 127 is connected. When the foot pad 127 is advancing away from the J-shaped base 7, the direction of travel of the chain 149 over the first or second one-way clutch is such that the clutch is not engaged and the clutch free wheels around the drive shaft 91. In this manner, the drive shaft 91 is alternatively driven by the foot pads 127 as they are advanced toward the U-shaped base 7. However, the return motion of the foot pads 127 away from the U-shaped base 7 does not engage the one-way clutches and does not cause the drive shaft 91 to rotate. The foot pads 127 can be advanced toward the U-shaped base 7 until the foot pads engage the stops 137 positioned on the front member 11 of the U-shaped base.

The motion that the user imparts to the foot pads 127 is a sideways motion. That is, the user causes his foot to move in a sideways direction as said foot pads 127 are caused to advance toward said side members 9 of the U-shaped base 7. The right foot will move to the right and the left foot will move to the left as the user activates the exercise device 5. The motion experienced by the user's feet on the foot pads 127 is substantially perpendicular to the motion experienced by a person's feet when walking or running. The movement of the foot pads 127 is in a direction that is substantially parallel to the front member 11 of the base 7.

Rotation of the drive shaft 91 causes the sprocket 95 to rotate along with the drive shaft 91. Rotation of the sprocket 95 causes the drive means 99 to be advanced in a direction that engages the one-way clutch 67 that is positioned on shaft 65. The engagement of the one-way clutch 67 causes the shaft 65 to rotate which in turn results in the rotation of the flywheel 73 that is secured to the shaft 65. Rotation of the shaft 65 also results in the counter wheel 79 rotating and the counting pickup 85 can be utilized to determine the rotational speed of the flywheel 73. Rotation of the flywheel 73 is inhibited by the action of the tension belt 75 positioned in the groove 71 on the flywheel 73. The tension control device 163 can be activated to increase the tension in the belt 75 and thereby either increase or decrease the resistance to rotation for the flywheel 73. Increasing or decreasing the resistance to rotation for the flywheel also acts to increase or decrease the resistance necessary to move the foot pads 127 in a direction toward the U-shaped base 7. The one-way clutch 67 is designed so that the shaft 65 can rotate freely when the sprocket 69 is not being advanced in a direction that causes the one-way clutch 67 to be activated. This allows the flywheel 73 to continue to rotate smoothly if the user of the exercise device 5 stops advancing the foot pads 127.

When the foot pads 127 move through the desired range of motion toward and away from the U-shaped base 7, the link member 133 acts to control the angular position of the foot pads 127. The link member 133 maintains the foot pads 127 at an angle that is substantially about 10° to about 20° throughout the range of motion for the foot pads 127.

Figure 6:
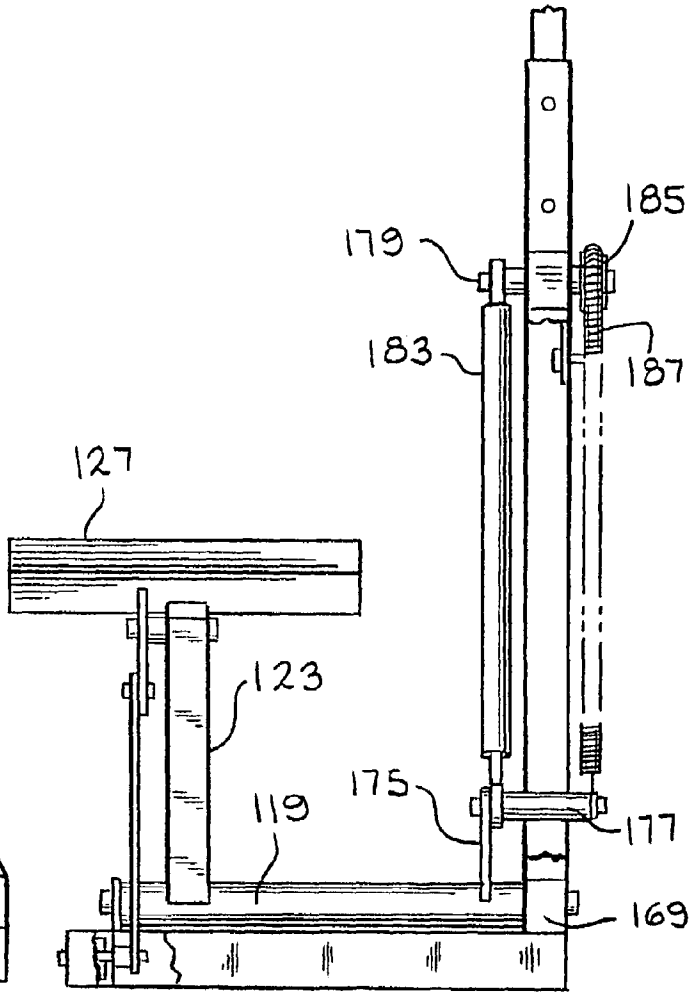
FIG. 6 is a side-elevational view of the embodiment of FIG. 5.
Figure 5:
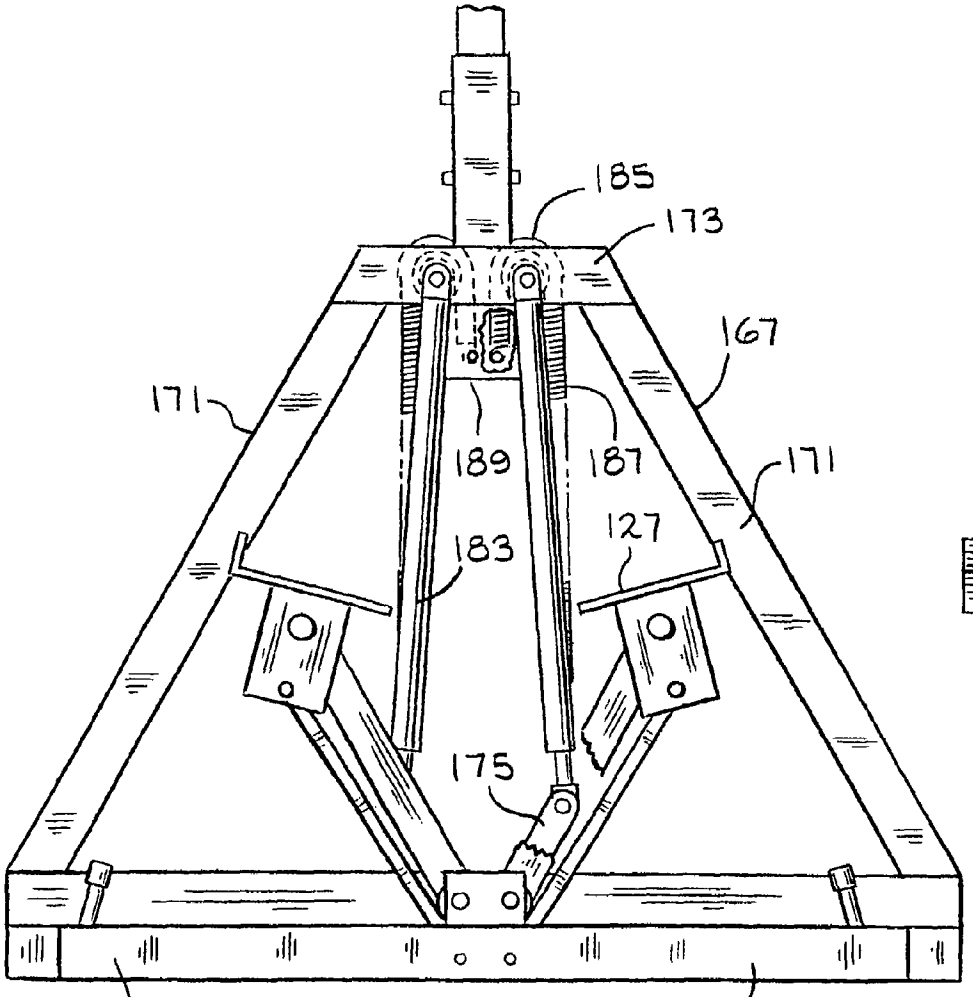
FIG. 5 is a front-elevational view of another embodiment of the invention.

FIGS. 5 and 6 show another embodiment of the present invention. To facilitate the description of this embodiment, the components that are the same as in the embodiment previously described will retain the same reference numerals, and only the different components will be given new reference numerals.

In this embodiment, the foot pads 127 are secured to the rotatable cylinders 11 9 in the manner previously described. A single truss member 167 having a horizontal base 169, sides 171 and a top cross member 173 is positioned on the end of the U-shaped base 7 that is spaced apart from the front member 11. A lever 175 is connected to the rotatable cylinders 119 on the end that is spaced apart from the arms 123 that support the foot pads 127. A shaft 177 is secured to each lever 175 and the shaft extends from the lever in a direction toward the single truss member 167. A pair of rods 179 extend through the top cross member 173 of the single truss member 167. One end of a hydraulic cylinder 183 is connected to each rod 179. The opposite end of the hydraulic cylinder is connected to the shaft 177 that extends from the lever 175 mounted on the rotatable cylinders 119. The hydraulic cylinders 183 are one-way hydraulic cylinders and only provide resistance when the cylinders are being extended. When the hydraulic cylinders are being compressed, there is essentially no resistance to this motion for the hydraulic cylinder. Positioned on the end of the rod 179 that is on the opposite side of the single truss member 167 from the hydraulic cylinder 185 is an idler roll 185. Positioned around the idler roll 185 is a spring 187. One end of the spring 187 is secured to a plate 189 that is connected to the top cross member 173. The other end of the spring 187 is secured to the end of the shaft 177 that is spaced apart from the lever 175.

The operation of the exercise device shown in FIGS. 5 and 6 is very similar to the operation previously described. As the foot pads 127 are caused to advance toward the U-shaped base 7, the hydraulic cylinder 183 operatively connected through the rotatable cylinders 119 to the foot pad will be caused to extend or elongate. The extension of the hydraulic cylinder will present resistance to this motion for the foot pad 127. In addition, as the foot pad 127 is advance toward the U-shaped base 7, the spring 187 will also be elongated also providing resistance to this motion for the foot pad 127. When the weight of the user is shifted from a particular foot pad 127 the force of the extended spring 187 will act upon the foot pad 127 through the rotatable cylinder 119 to cause the foot pad to move in a direction away from the U-shaped base 7.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense.

I claim:

1. An exercise device comprising:

a base;

a first arm, pivotally mounted to said base at a first point and having a first foot pad spaced apart from said first point and operatively connected to said first arm such that said first foot pad is disposed to move in a first arcuate path in a substantially vertical plane about said first point;

a second arm, pivotally mounted to said base at a second point independent of said first point and having a second foot pad spaced apart from said second point and operatively connected to said second arm such that said second foot pad is disposed to move in a second arcuate path in the same substantially vertical plane about said second point; and means for providing resistance to the motion of said first foot pad and said second foot pad;

wherein said means for providing resistance only provides resistance to the motion of said first foot pad when said first foot pad is moving in said first arcuate path towards said base and said means for providing resistance only provides resistance to the motion of said second foot pad when said second foot pad is moving in said second arcuate path towards said base.

2. The device of claim 1 further comprising means to bias said first foot pad to return along said first arcuate path away from said base and means to bias said second foot pad to return along said second arcuate path away from said base.

3. The device of claim 1 wherein a hand grip is attached to and spaced apart from said base, said hand grip providing a balancing support for a user of said device.

4. The device of claim 1 wherein a first base plate is pivotally mounted to said first arm and said first foot pad is secured to said first base plate and a second base plate is pivotally mounted to said second arm and said second foot pad is secured to said second base plate.

5. The device of claim 4 wherein a first link member is positioned to extend from said first base plate to said base, said first link member being pivotally secured to said base and said first foot pad, said first link member acting to maintain said first foot pad at a first desired angle as said first foot pad travels through said first arcuate path; and wherein a second link member is positioned to extend from said second base plate to said base, said second link member being pivotally secured to said base and said second foot pad, said second link member acting to maintain said second foot pad at a second desired angle as said second foot pad travels through said second arcuate path.

6. The device of claim 5 wherein both said first desired angle and said second desired angle are from about 10° to about 20° with respect to a surface upon which said exercise device is positioned.

7. A method of exercising comprising:

providing an exercise machine including:

a first arm, pivoting at a first point and having a first foot pad spaced apart from said first point and operatively connected to said first arm such that said first foot pad is disposed to move in a first arcuate path in a substantially vertical plane about said first point; and a second arm, pivoting at a second point independent of said first point and having a second foot pad spaced apart from said second point and operatively connected to said second arm such that said second foot pad is disposed to move in a second arcuate path in the same substantially vertical plane about said second point;

placing a foot on each of said first foot pad and said second foot pad;

performing a side-to-side stepping motion by pushing down on said first foot pad and said second foot pad in sequence; and providing independent resistance to each said foot pad.

8. The method of claim 7 wherein said side-to-side stepping motion is substantially perpendicular to the motion experienced when walking or running.

9. An exercise device comprising:

a base;

a first arm, pivotally mounted to said base at a first point and having a first foot pad spaced apart from said first point and operatively connected to said first arm such that said first foot pad is disposed to move in a first arcuate path in a substantially vertical plane about said first point;

a second arm, pivotally mounted to said base at a second point independent of said first point and having a second foot pad spaced apart from said second point and operatively connected to said second arm such that said second foot pad is disposed to move in a second arcuate path in the same substantially vertical plane about said second point;

at least one resistance device positioned to resist the motion of said first foot pad and at least one resistance device positioned to resist the motion of said second foot pad;

a first link member pivotally secured to said base and said first foot pad, said first link member acting to maintain said first foot pad at a first desired angle as said first foot pad travels through said first arcuate path; and a second link member pivotally secured to said base and said second foot pad, said second link member acting to maintain said second foot pad at a second desired angle as said second foot pad travels through said second arcuate path.

10. The device of claim 9 further comprising means to bias said first foot pad to return along said first arcuate path away from said base and means to bias said second foot pad to return along said second arcuate path away from said base.

11. The device of claim 9 wherein a hand grip is attached to and spaced apart from said base, said hand grip providing a balancing support for a user of said device.

12. The device of claim 9 wherein a first base plate is pivotally mounted to said first arm and said first foot pad is secured to said first base plate and a second base plate is pivotally mounted to said second arm and said second foot pad is secured to said second base plate.

13. The device of claim 9 wherein both said first desired angle and said second desired angle are from about 10° to about 20° with respect to a surface upon which said exercise device is positioned.

14. The device of claim 9 wherein said at least one resistance device positioned to resist the motion of said first foot pad and at least one resistance device positioned to resist the motion of said second foot pad comprise the same resistance device.

15. The device of claim 9 wherein said at least one resistance device positioned to resist the motion of said first foot pad and at least one resistance device positioned to resist the motion of said second foot pad comprise different resistance devices.

16. The device of claim 9 wherein said first arm and said second arm move independently of each other.

* * * * *